US006286519B1

(12) United States Patent
Stachowski

(10) Patent No.: US 6,286,519 B1
(45) Date of Patent: Sep. 11, 2001

(54) DEVICE FOR STYLING HAIR

(76) Inventor: Barbara Stachowski, 11 El Gavilan, Orinda, CA (US) 94563

( * ) Notice: Subject to any disclaimer, the term of this patent is extended or adjusted under 35 U.S.C. 154(b) by 0 days.

(21) Appl. No.: 09/549,764

(22) Filed: Apr. 14, 2000

(51) Int. Cl.[7] ..... A45D 8/04

(52) U.S. Cl. ..... 132/273; 132/133; 132/150; 132/207

(58) Field of Search ..... 132/273, 123, 132/118, 120, 121, 122, 147, 145, 208, 108, 133, 150, 161, 110

(56) References Cited

U.S. PATENT DOCUMENTS

| | | | | |
|---|---|---|---|---|
| 3,861,405 | * | 1/1975 | Pellecchia | 132/144 |
| 5,012,830 | * | 5/1991 | Vaccaro et al. | 132/231.1 |
| 5,348,030 | * | 9/1994 | Hirzel | 132/123 |
| 5,503,109 | * | 4/1996 | Sporn | 119/94 |
| 5,921,252 | * | 7/1999 | Chubb | 132/144 |
| 6,029,307 | * | 2/2000 | Baudoin | 15/145 |
| 6,062,231 | * | 5/2000 | De Laforcade | 132/145 |
| 6,070,596 | * | 6/2000 | Altamore | 132/224 |

* cited by examiner

*Primary Examiner*—John J. Wilson
*Assistant Examiner*—Robyn Kieu Doan

(74) *Attorney, Agent, or Firm*—Haverstock & Owens LLP

(57) ABSTRACT

This invention is a device for parting hair into a preferred style. The device has an extended point that is preferably a solid point and two handles that each hinge about the point such that the handles open and close in a jaw like fashion. The handles are preferably flattened elongated handles that are larger at the holding ends for easy operation and handling of the device. The tip is also preferably flattened and substantially co-planar with the handles or positioned at an angled of 45 degree or less relative to the plane of the flattened handles. In an alternative embodiment of the invention, the handles section are connected together by a single hinge near or at the tip section of the device. Hair is parted into the preferred configuration by tracing the tip of the device through a section of hair with the handles in the closed position such that the hair flows over the handles and accumulates on the handles. The handles are then opened thus separating the hair and forming the part. The device may be used for making any number of parting configurations with hair and is particularly useful for making irregular and zig-zag parting configuration with hair. The device is monolithic and made from a resilient material or is made in parts which may be configured to disassemble. In other embodiments of the invention, the device is equipped with a lock to hold the device in a closed position and with a spring between the handles for urging the handles to open and making the device easy to operate with one hand.

31 Claims, 8 Drawing Sheets

DEVICE FOR STYLING HAIR

FIELD OF THE INVENTION

The invention relates to hair styling devices. More specifically, this invention relates to hair styling devices for creating parts in hair and separating hair.

BACKGROUND OF THE INVENTION

Hair styling often involves manipulating hair into a preferred orientation or style and securing the hair in that preferred orientation or style. This current invention is a device for manipulating hair into a preferred orientation or style by parting or separating sections of hair. Hair is usually parted or separated with a comb or a brush. It can be difficult to obtain a straight part or a consistent part with theses well known devices. It is even more difficult to create a complex part in hair such as a curved or a zig-zag part. In order to make a zig-zag part, for example, with a comb or a brush, each section of hair must be carefully combed or brushed and then separated. The current invention provides a device and method for creating complex parts in a hair style quickly and easily.

SUMMARY OF THE INVENTION

This invention is a device and method for parting hair in a preferred configuration. In one embodiment of the invention the device has a solid extended tip section and two elongated handles. The elongated handles are attached by one of their ends to the tip section such that the handles are capable of being opened and closed in a "jaw-like" fashion about the tip section. The handles are preferably flattened and substantially planar with enlarged or flared grasping ends. Most preferable, the tip section is also flattened and is co-planar with the handles. In an alternative embodiment, the tip section is angled. The angle of the tip, relative to the handles and the plane formed by the handles, is preferably less than 45 degrees.

Each of the two handles are attached to the tip portion through a hinge element which allow the handles to be opened and closed. The hinge elements are any hinge elements known in the art such as hinge pins which typically interlock rotatable parts. The hinge elements may also include tension coil springs that cause the handles to return to the open or the closed position in the absence of an applied force. In the most preferred embodiment of the invention the hinge elements are leaf springs made of a resilient deformable material, wherein the handles are placed in the opened or closed position by deforming the leaf springs.

In the most preferred embodiment of the invention, the device is monolithic and formed from a resilient material. The resilient material is preferably plastic, rubber or polyurethane. However, it will be clear to one skilled in the art that the device can also be made from any number of resilient materials including spring metals or any combination of the aforementioned materials. In the most preferred embodiment, the leaf springs are provided by a modified structure at the hinging points in the monolithic device. For example, by having reduced thicknesses of the resilient material at the hinging points, the handles will bend through these points when a deforming force is applied to the handles. Further, it is preferred that the handles will return their original resting position in the absence of the applied force and that the original resting position is the closed position.

In an alternative embodiment of the invention, a grooming element such as a comb or a brush section is detachable fixed to the device. In this way the device can serve as the handle for the attached comb or brush which can then be removed when using the device to part hair.

In other embodiments, the complete device, or parts of the device, function as a hair pin. For example, in one embodiment of the invention at least one of the handles is detachable from the tip portion of the device. The detached handle of the device is then free to be used as a hair pin.

In still another embodiment of the invention, the device has a locking mechanism to secure the device in a closed position. The locking mechanism, preferably secures the handles in the closed position near the unattached or free ends of the handles. The locking mechanism is preferably a hook that hinges on one of the handles and is capable of wrapping around a portion or receiving section of the other handle when the handles are in the closed position. Further, providing the adjacent interior surfaces of the handles with small teeth allows the device to secure a section of hair between the handles while the handles are in the closed position and are secured, thus providing for a device that is also capable of being used as a hair clip.

In still another embodiment of the invention, the device has a spring element that is in contact with both handles for urging the handles to the open position. In this embodiment of the invention, the device is capable of being held in the closed position with one hand and allowed to open without using the another hand. This embodiment allows a hair stylist to create a complex hair part with one hand while leaving the other hand free to perform other tasks.

In an alterative embodiments, the device has two handle sections that are connected together by a single hinge element. In this embodiment the ends of the handles form the tip of the device. Whether the device has a single hinge or two hinges, a part in the hair is created by guiding or tracing the tip of the device through a section of hair near the scalp with the tip section pointing in the forward direction of the trace. The trace is performed in such as way as to keep the device closed to the scalp throughout the trace and to trace out the shape or design of the part that is desired. While tracing out the part, the hair will collect on the handles of the device and by separating the handles the hair is separated and parted. The device may be used for making any number of hair styles or configurations in hair but particularly useful for making irregular and zig-zag parts in hair.

DETAILED DESCRIPTION OF THE INVENTION

Figure 1:
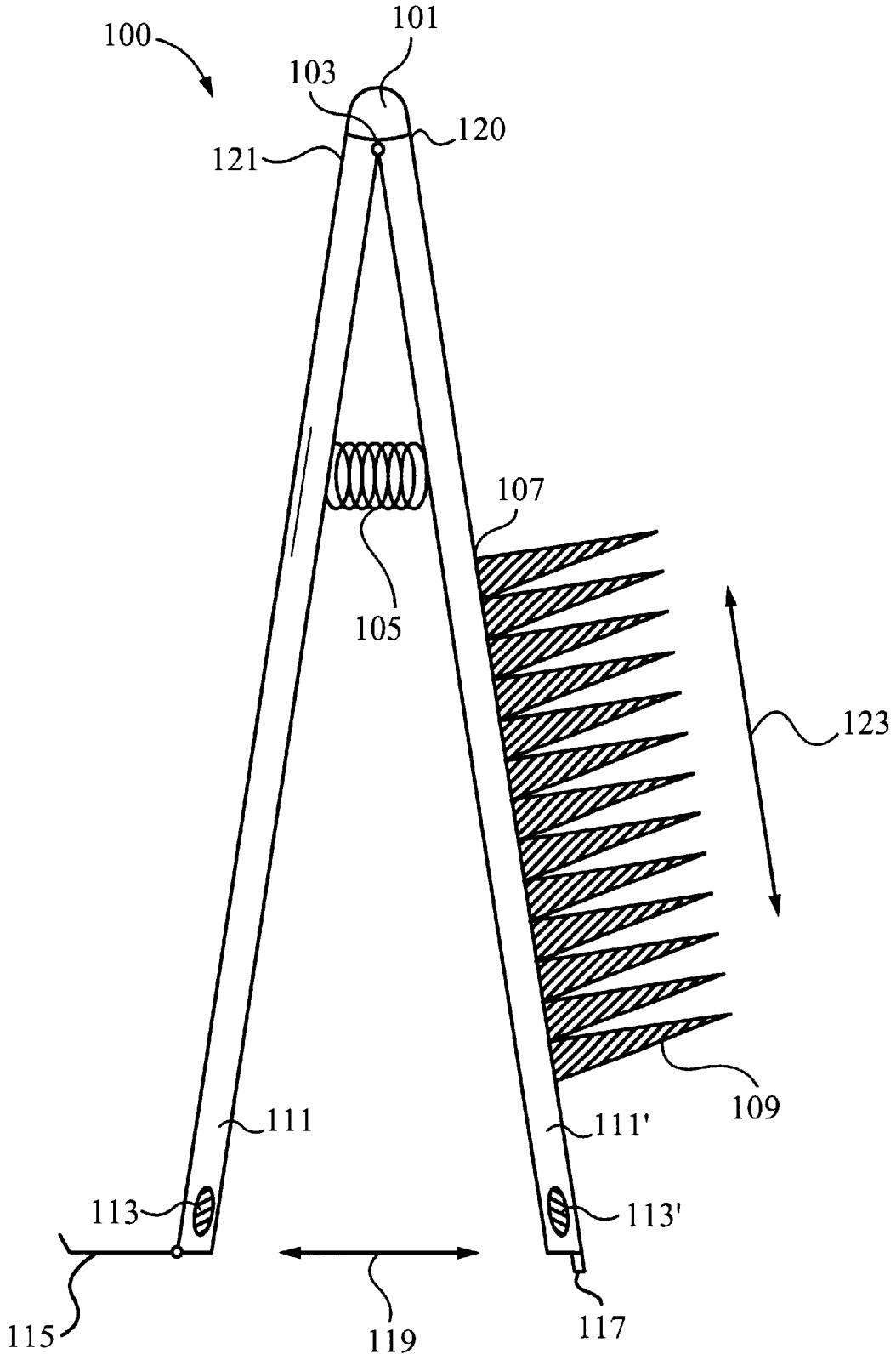
FIG. 1 shows a hair styling device according to the current invention with detachable comb section.

FIG. 1 illustrates a device 100 according to one embodiment of the current invention. The device 100 has two elongated handles 111 and 111' that are connected together at one end of each handle 120 and 121 through a hinge element 103. The ends 120 and 121 form a tip section 101 that is used to guide the device through hair to form a part in the hair. The device 100 is capable of being placed in an open position (as shown) and place in a closed position (not shown) by separating the handles 111 and 111' and bring the handles together in a "jaw-like" fashion as indicated by the arrow 119. The tip section 101 preferably does not open or close or become in anyway separated while moving the handles 111 and 111' as described. This is accomplished in any number of ways. One way to accomplish this goal is by attaching the handles 111 and 111' through a hinge element at the very ends 120 and 121 of the handles 111 and 111' such that the hinge and the tip section of the device are the same thing (not shown). The hinge element in this case is preferably a leaf spring hinge as described below so that hair is not snagged or caught in the device during its use. Secondly, the device is configured with the attached ends 120 and 121 of the handles 111 and 111' to be flattened, curved and overlapping such that a gap does not form in the tip section 101 during the opening and closing motion of the device 100.

Again referring to FIG. 1, the handles are equipped with finger pads 113 and 113' for grasping and positioning the device 100 in the opened and closed positions.

According to a further embodiments of the invention, the device 100 has a spring element 105 position between the handles 111 and 111' for urging the handles 111 and 111' to separate to the open position. In yet another embodiment of the invention, the device 100 has a locking element for securing the device 100 in the closed position. A latch 115 is attached to the handle 111. A receiving post 117 is attached to the handle 111'. The device 100 is placed in the closed position and the latch 115 is folded over the receiving post 117 and thus securing the device 100 in the closed position. While a two part locking element is preferred, a simple hook attached to one handle that is capable of looping around the other handle in order to secure and lock the handles in the closed position is considered to be within the scope of the invention.

In an alternative embodiment of the invention, a grooming element such as a comb or a brush section 109 is attached to a portion 107 of the device handle 111'. Preferably the grooming element 109 is detachable fixed to the portion 107 of the handle 111' and can be removed when using the device 100 to create parts in hair. The grooming element 109 is detachably fixed to a portion of the handle 107 by any suitable means including two piece interlocking snaps or hooking fabric interlocks. Alternatively, the grooming element 109 may be slidably positioned into to a grove on the side of the handle 107 such that sliding the grooming element 109 in one direction or the other direction along the length of the handle 111', as indicated by the arrow 123, allows the element to be released from the handle 111'.

Figure 2A:
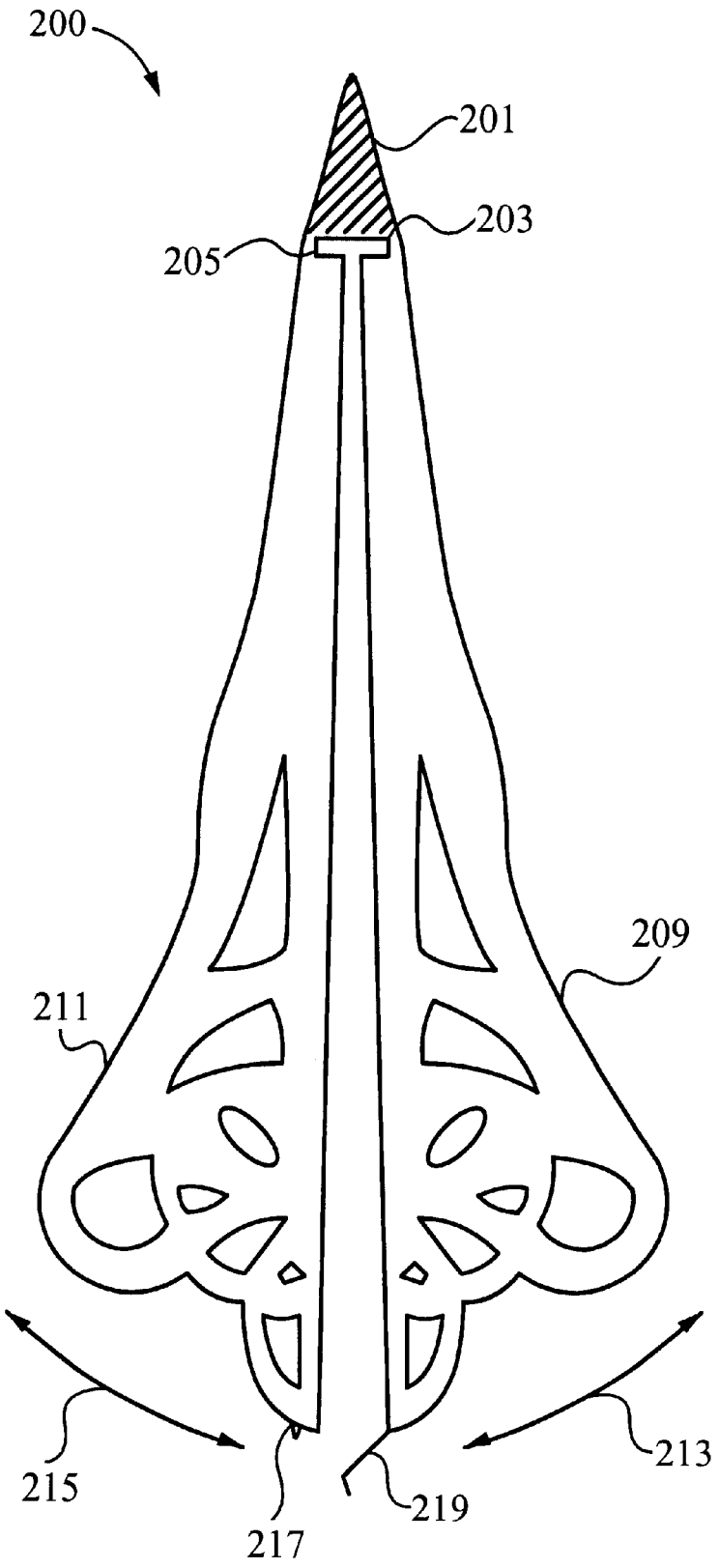
FIG. 2*a* shows a hair styling device with leaf spring hinges according to the present invention.

In preferred embodiments of the invention the hair styling device 200 has two handles 209 and 211 that are independently attached to a tip section 201 as shown in FIG. 2*a*. Preferably the ends of the handles 211 and 209 are flared at the grasping ends and are reticulated as shown for providing both beauty and function to the device 200. The tip section 201 is used to guide the device 200 through hair during a styling operation. The handles 209 and 211 move in the directions 213 and 215 through the hinge elements 203 and 205, respectfully. By moving the handles 209 and 211 towards each other the device will assume a closed position, as shown, and by separating the handles 209 and 211 apart from each other the device 200 is placed an open position. Upon releasing the handles 209 and 211 the device 200 will preferably return to the closed position.

Hinge elements used in the styling device of the current invention are hinge pins, hinge pins that are couple with tension coil springs (not shown) or hinge screws. Hinge pins coupled with tension coil springs are used to urge the handles to assume a closed or open position in the absence of an applied force. In the preferred embodiment of the invention the hinge elements 203 and 205 are leaf spring hinge elements as shown in FIG. 2*a*.

In one embodiment of the current invention the invention the device 200 is monolithic, wherein the tip section 201, the hinge elements 203/205 and the handles 209/211 are formed from a single resilient pliable material such as plastic, rubber or polyurethane. In this embodiment, the leaf spring hinge elements 203 and 205 are thin pieces of the resilient pliable material connecting the thicker tip section 201 and the thicker handles 209/211 such that the hinge elements 203 and 205 flex or bend when handles 209 and 211 are pulled apart or drawn together.

While the device 200 is shown as a monolithic device, it will be clear to one skilled in the art that the device 200 may be made of several parts and using any number of different materials. For example, in an alternative embodiment the handles 209/211 and tip section 201 are plastic connected together through metal leaf spring hinge elements.

Figure 2B:
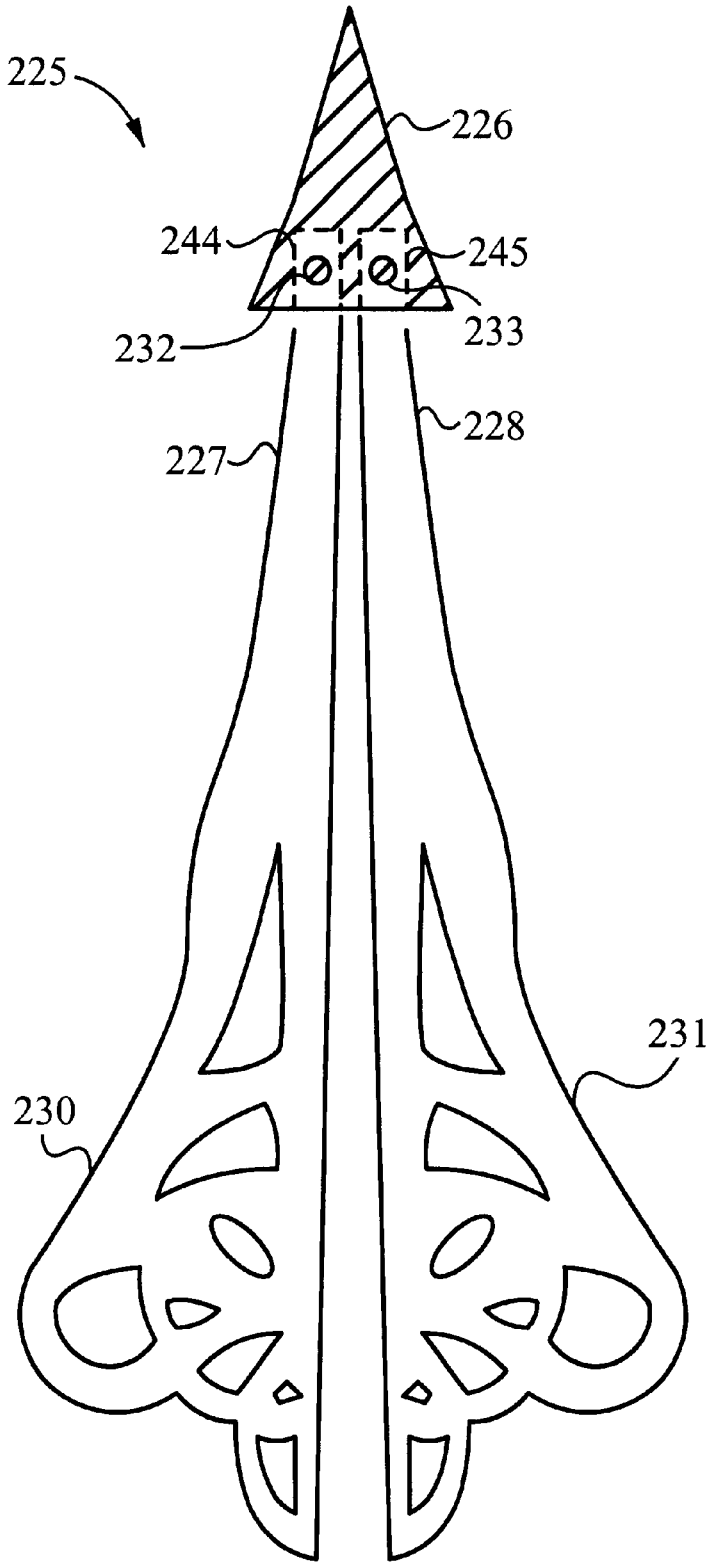
FIG. 2*b* shows a hair styling device according to the preferred embodiment of the present invention.

The most preferred embodiment of the invention is shown in FIG. 2*b*. The device 225 has a plastic tip section 226 with hollow inserts, shown by the dotted lines 244/245, for inserting and attaching ends 227/228 of the handle sections 230/231, respectively. The handle sections 230/231 are then held fixed to the tip section 226 with screws 232/233 which are also the hinge elements. The handles are capable of opening and closing in a jaw like fashion through the screw hinges 232/233 as described previously.

Figure 3:
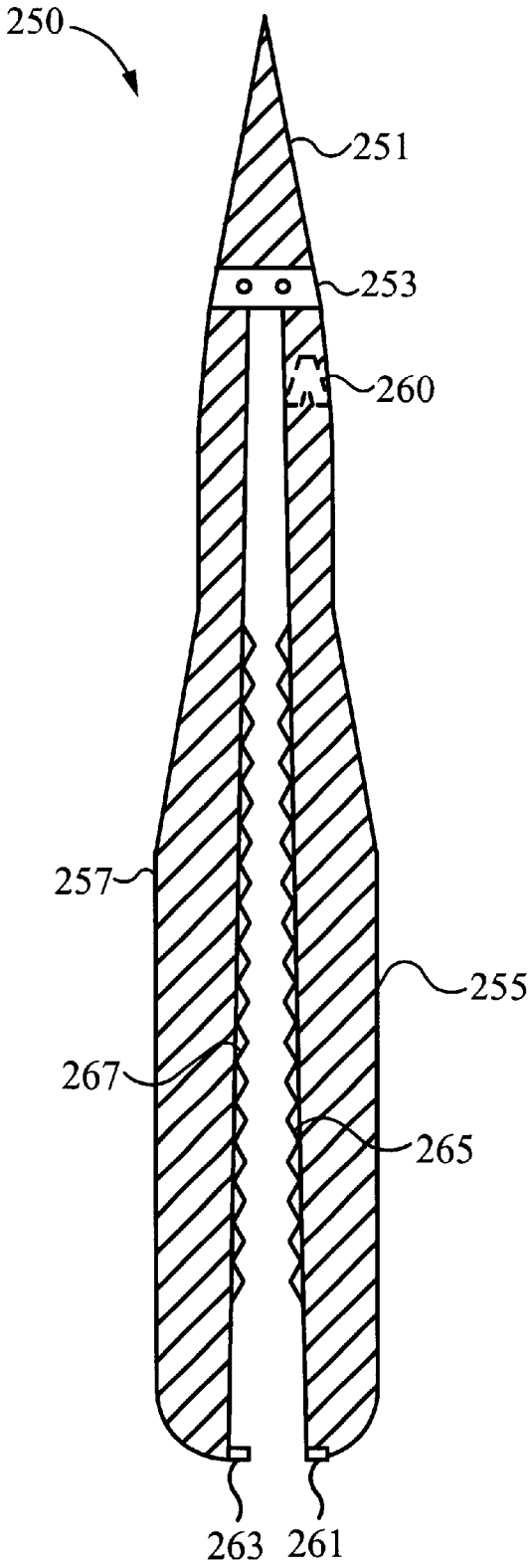
FIG. 3 shows a hair styling device according to the current invention that is also capable of being used as a hair clip and a hair pin.

FIG. 3 shows a device 250 incorporating several alternative embodiments according to the present invention. The device 250 has two handles 255 and 257 that are hingably attached by a hinge section 253 to a tip section 251, wherein the handles 255 and 257 open and close in a "jaw-like" fashion as described previously. The device 250 also has a two part pressure snap mechanism comprising a female portion 261 and male portion 263 that snap together and secure that device 250 in a closed position. The handle 255 is capable of being detached at the insert joint 260 from the rest of the device and is capable of being used as a hair pin. Further, adjacent interior portions 265/267 of the handles 255/257 have teeth 265/267 for holding hair between the handles 255/257 with the device 250 secured in the closed position. Thus the device 250 may also be used as a hair clip when it is not being used to style hair.

Figure 4A:
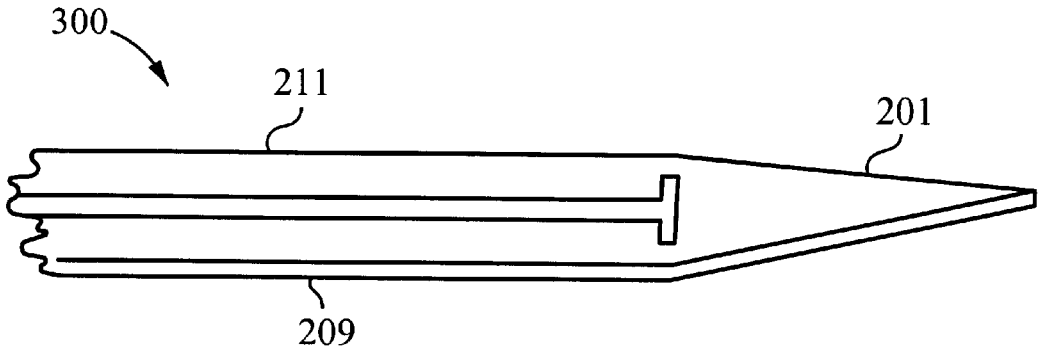
FIGS. 4*a–b* illustrate straight and bent tip sections according to alternative embodiments of the current invention.
Figure 4B:
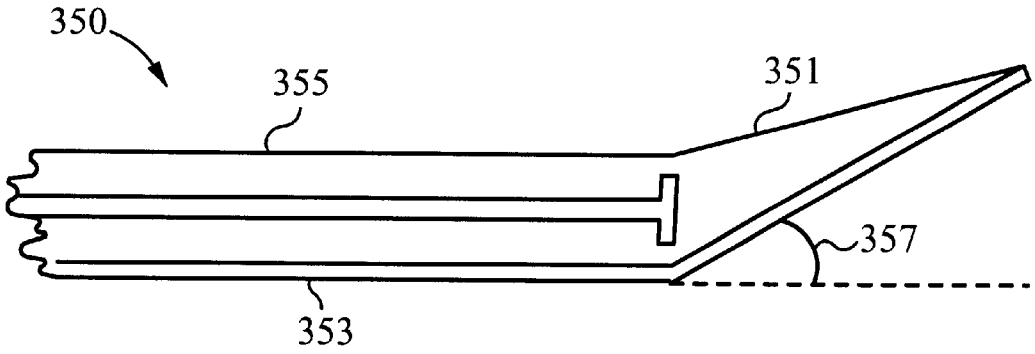

FIG. 4*a* shows a perspective view 300 of a portion of the device 200 shown in FIG. 2. The tip section 201 is flattened and coplanar with the handles 209 and 211. FIG. 3*b* shows a tip section 351 that is fattened and is angled relative the handles 353 and 355. Tip sections of the device can assume any number of angular positions depending on the preference of the user, but typically the device will be easier to use if the angle 357 of the tip 351 is not so greater than 45 degrees relative to the handles 353 and 355.

Figure 5A:
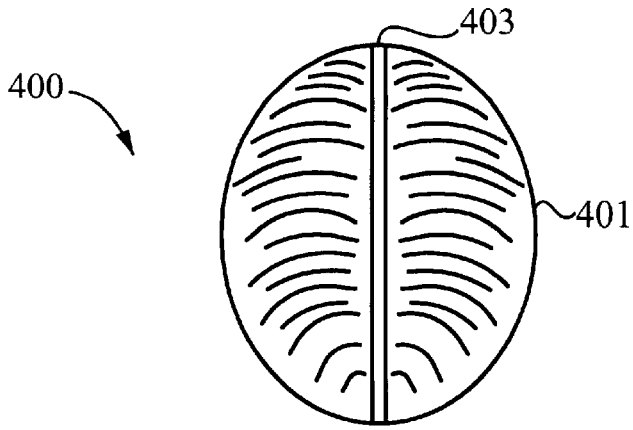
FIGS. 5*a–c* illustrate top views of parts in hair that are made using the device according to the method of the current invention.
Figure 5B:
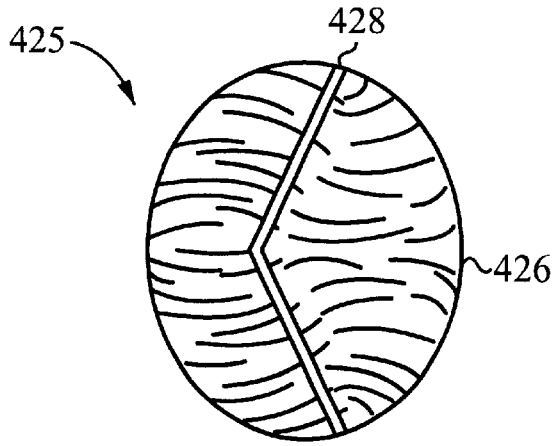
Figure 5C:
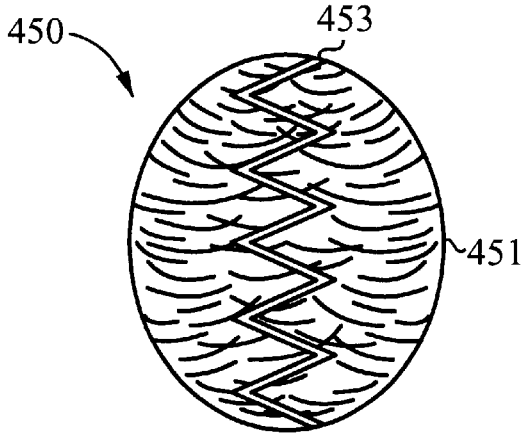

Embodiments of the invention described above are useful for creating many different configurations of parts in hair. For illustrative purposes, a few of the parts in hair that can be created with the hair styling device of the current invention are shown in FIGS. 5*a–c*. FIG. 5*a* shows a top view 400 of a the head 401 with hair that is parted in a straight line 403 using the hair styling device of the current invention. FIG. 5*b* shows a top view 425 of a head 426 with hair that is parted at an angle 428 using the hair styling device of the current invention. FIG. 5*c* shows a top view 450 a head 451 with hair that is parted in a zig-zag fashion 453 using the device of the current invention. The hair styling device described, herein, may be used to part hair in any number of simple and complex ways and is particularly useful to create complex parts such as the zig-zag part shown in FIG. 5*c*.

Figure 6:
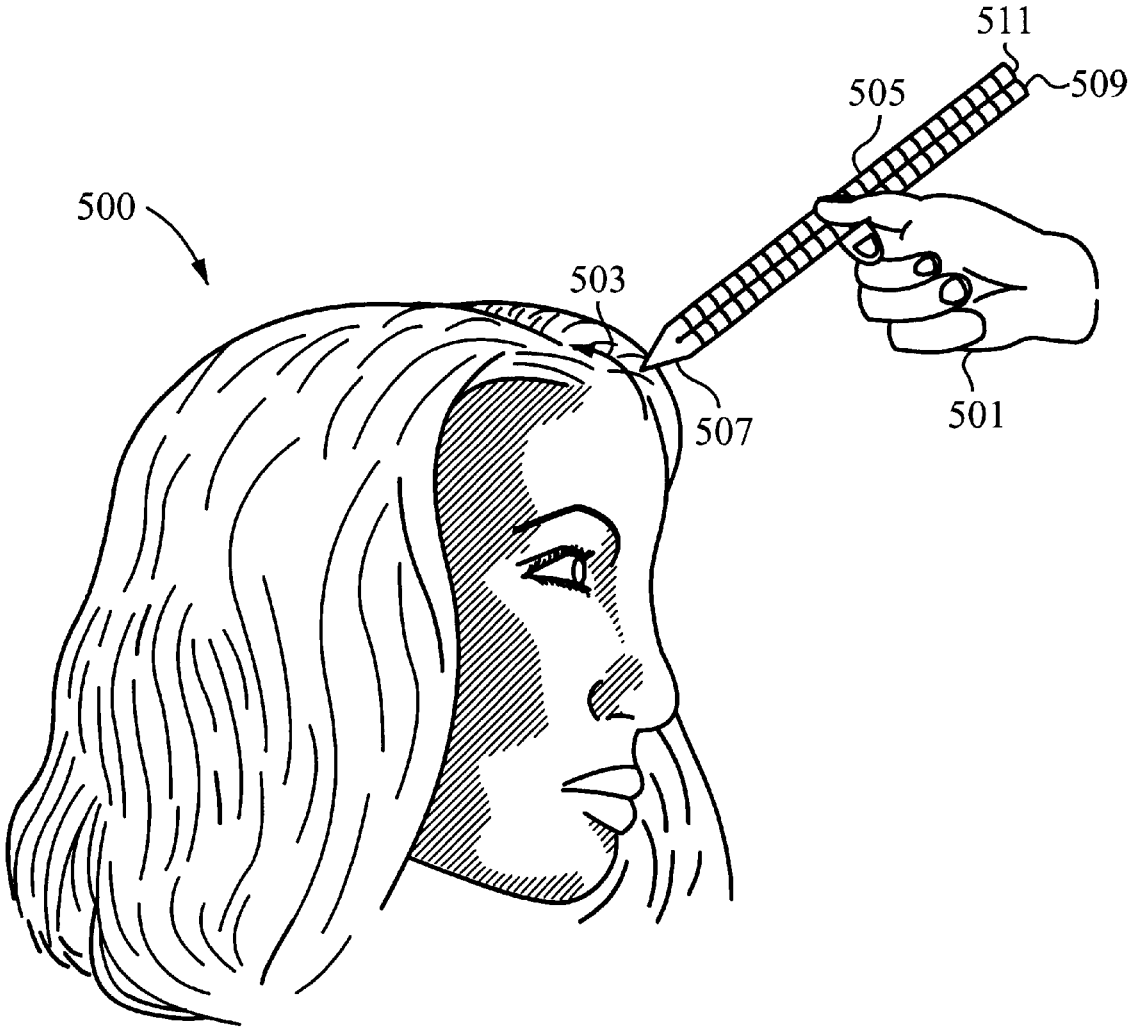
FIG. 6 illustrates a method of using the parting device in accordance with the current invention.

FIG. 6 illustrates a perspective view of a women's hair 500 being parted with a hair styling device 505 according to the present invention. The device 505 is held in the closed position with one hand 501 as shown in FIG. 6 or with both hands (not shown). The tip section 507 of the device is placed in the hair and near to the scalp and moved through the hair in a motion over the head and through the hair 500. The tip section 507 of the device 505 is used to trace out the desired configuration of the part. While tracing out the part 503 the hair will flow over the handles 509/511 of the device and collect thereon. Once the trace of the part 503 is complete, the device 505 is paced in the open position by separating the handles 509 and 511 thus separating the hair according to the part traced.

Figure 7:
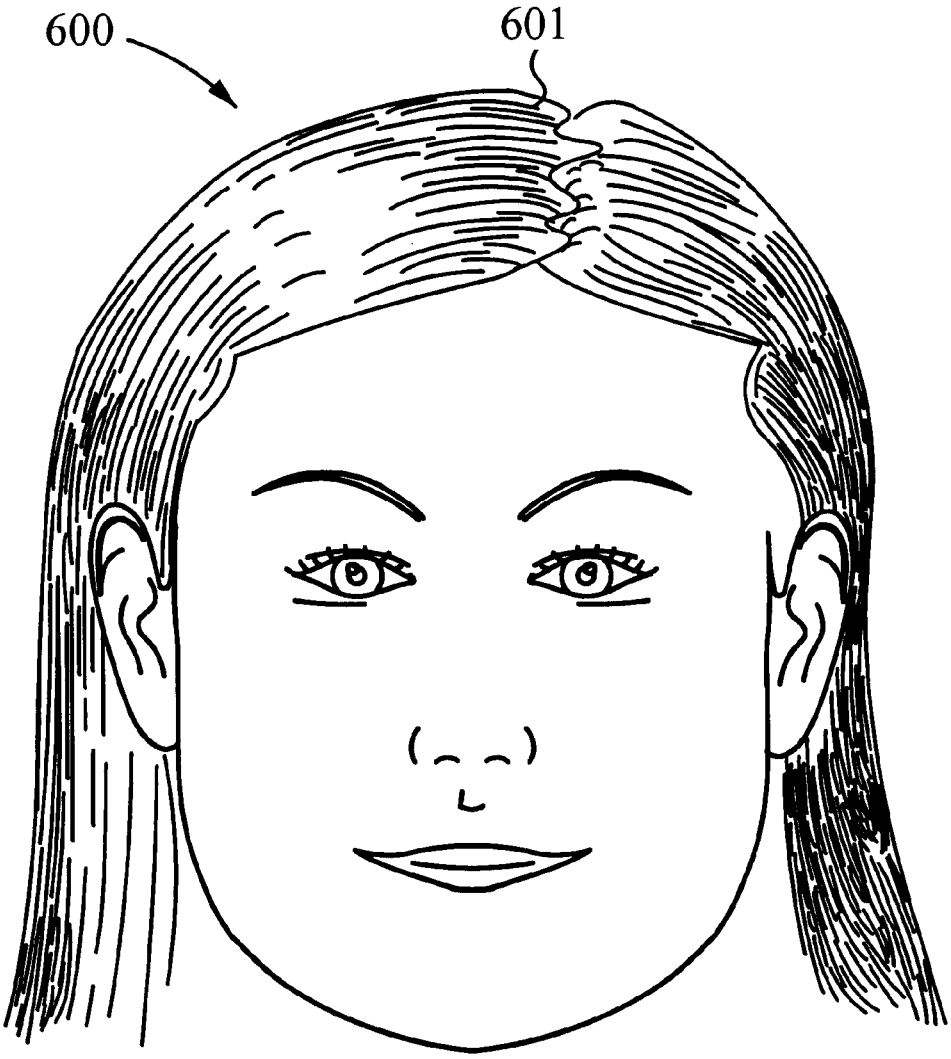
FIG. 7 illustrates a perspective view of a zig-zag part in a hair style made in accordance with the current invention.

FIG. 7 illustrates a perspective view of a women's hair 600 that is parted with a zig-zag part 601 according to the method of the current invention. The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device of the present invention could be implemented in several different ways and have several different appearances.

What is claimed is:

1. A hair styling device for separating hair in a preferred configuration, the hair styling device comprising a first handle and a second handle, the first handle being attached to a pointed tip section through a first hinge element and the second handle being attached to the pointed tip section through a second hinge element, wherein unattached ends of the handles are capable of being aligned in a closed position and separated in an open position in a jaw like fashion about the pointed tip section through the first hinge element and the second hinge element.

2. The device of claim 1, wherein at least one of the first hinge element and the second hinge element is selected from the group consisting of a pin, a screw and a leaf spring.

3. The device of claim 1, wherein the first hinge element and the second hinge element are resilient leaf springs.

4. The device of claim 3, wherein the first handle, the second handle and the section are monolithic and formed from a resilient material.

5. The device of claim 4, wherein the resilient material is selected from the group consists of plastic, polyurethane and rubber.

6. The device of claim 1, wherein the pointed tip section and the first handle and the second handle are flattened and substantially planar.

7. The device of claim 1, wherein the pointed tip section is bent at an angle of less than 45 degrees relative to the handles and to the plane they form when aligning the handles in the closed position and separating the handles in the open position.

8. The device of claim 1, wherein the first handle and the second handle are flared at the unattached ends for grasping and positioning the first handle and the second handle in the open and in the closed position.

9. The device of claim 8, wherein the unattached ends of the first handle and the second handle are reticulated.

10. The device of claim 1, further comprising a hair grooming element attached to a portion of at least one of the first handle and the second handle, the hair grooming element being selected from the group consisting of a brush and a comb.

11. The device of claim 10, wherein the hair grooming element is detachable from the portion of the at least one of the first handle and the second handle.

12. The device of claim 1, wherein at least one of the first handle and the second handle is detachable from the pointed tip section and wherein the separated pieces are capable of being used as hair pins.

13. The device of claim 1, further comprising a means to secure the first handle and the second handle in the closed position.

14. The device of claim 13, wherein the means to secure the first handle and the second handle in the closed position comprises a hook element attached to one of the handles and an receiving element on the other handles wherein engaging the hook element with the receiving element secures the first handle and the second handle in the closed position.

15. The device of claim 13, further comprising teeth extending from adjacent portions of the first handle and the second handle for securing hair positioned between the first handle and the second handle with the first handle and the second handle secured in the closed position, such that the device is capable of being used as a hair clip.

16. The device of claim 1, further comprising a spring element positioned between the first and handle the second handle for urging the first handle and the second handle to the open position.

17. A hair styling device for parting hair comprising:

a) an extended tip section comprising a pointed end;

b) a first handle section with a proximal and distal end;

c) a second handle section with a proximal and distal end; and d) a first hinge for adjoining the first handle near its distal end to the extended tip section; and e) a second hinge for adjoining the second handle near its distal end to the extended tip section, wherein the device is capable of being place in a closed position by aligned the proximal ends and placed in an open position by separating the proximal ends and wherein the device is capable of separating hair in the preferred configuration by holding tie device in the closed position, guiding the pointed end of the extended tip section through a section of hair causing the hair to flow over portions of the first and the second handle sections and placing the device in the open position, thereby separating the hair.

18. The device of claim 17, wherein the at least one of the first hinge and the second hinge comprises an element selected from the group consisting of a coiled leaf spring, a pin and a screw.

19. The device of claim 17, wherein the first and the second handle sections are elongated and flattened.

20. The device of claim 19, wherein the first and the second handle sections are flared at their proximal ends for grasping and placing the device in the open and closed positions.

21. The device of claim 20, wherein the proximal ends of the first and the second handle sections are reticulated.

22. The device of claim 17, further comprising a hair grooming element attached to a portion of at least one of the first and the second handle sections, the hair grooming element being selected from the group consisting of a brush and a comb.

23. The device of claim 22, wherein the hair grooming element is detachable from the portion of the at least one of the first and the second handle sections.

24. The device of claim 17, wherein the first and the second handle sections are separable and wherein at least one of the separated handle sections is capable of be used as a hair pin.

25. The device of claim 17, further comprising a means to secure the device in the closed position.

26. The device of claim 25, wherein said means to secure the device in the closed position comprises a hook attached to the proximal end of the first handle section and a receiving section on the proximal end of the second handle section, wherein engaging the hook in the receiving section secures the device in the in the closed position.

27. The device of claim 25, further comprising teeth on portions of at least one of the first and the second handle sections for securing hair between the first and the second handle sections with the device on the closed position.

28. The device of claim 17, further comprising a spring element positioned between the first and the second handle sections for urging the handle sections to separate.

29. A method for parting hair in a preferred configuration comprising the step of:

a) placing a pointed tip portion of a styling device into a section of hair, the styling device comprising a first and a second handle coupled by one end of each of the first and a second handles to the pointed tip portion through a first and a second hinge element;

b) tracing a desired part through the section of hair with the handles aligned in a closed position and the pointed tip portion pointing in a forward tracing direction; and c) separating the handles to an open position about the pointed tip portion, thereby parting the hair in the preferred configuration.

30. A device for parting hair comprising;

a) means to trace, for tracing a part through a section of hair, the means to trace comprising a pointed tip for guiding, the device near the user's scalp while tracing the part; and b) means to seperate the hair along the part, the means to seperate the hair along the path comprising a first and a second handle each coupled to the means to trace through a first and a second hinge element, such that the hair is capable of being seperated without removing the means to trace from the section of hair.

31. A method making a hair parting device comprising the steps of:

a) forming a first elongated handle;

b) forming a second elongated handle;

c) forming an extended tip section with a pointed end and an opposite attaching end; and d) attaching the first and second elongated hands near to the opposite attaching end of the extended tip section through hinge elements, such that unattached ends of the handles are capable of being aligned in a closed position and seperated in an open position in a jaw like fashion through the hinge elements.

* * * * *